United States Patent [19]

Pinson

[11] Patent Number: 4,615,496

[45] Date of Patent: Oct. 7, 1986

[54] HYBRID SEMI-STRAPDOWN INFRARED SEEKER

[75] Inventor: George T. Pinson, Huntsville, Ala.

[73] Assignee: The Boeing Company, Seattle, Wash.

[21] Appl. No.: 688,532

[22] Filed: Jan. 3, 1985

[51] Int. Cl.[4] ..... F41G 7/22

[52] U.S. Cl. ..... 244/3.16

[58] Field of Search ..... 244/3.16

[56] References Cited

U.S. PATENT DOCUMENTS 2,877,354 3/1959 Fairbanks et al. ..... 244/3.16

3,725,576 4/1973 Crawford et al. ..... 244/3.16

4,158,845 6/1979 Pinson ..... 244/3.16

4,521,782 6/1985 Pinson ..... 244/3.16

*Primary Examiner*—Charles T. Jordan

*Attorney, Agent, or Firm*—Edwin H. Crabtree

[57] ABSTRACT

A hybrid semi-strapdown infrared seeker for mounting in a missile or the like. The seeker processing both imaged and non-imaged data available around a potential target area displayed on a vidicon and providing a level of target identification, target discrimination, target acquisition and attack at the target's controid or other selected points on the target.

9 Claims, 3 Drawing Figures

HYBRID SEMI-STRAPDOWN INFRARED SEEKER

BACKGROUND OF THE INVENTION

This invention relates to a missile seeker for target acquisition and more particularly, but not by way of limitation, to an infrared seeker which may be gimbal attached or non-gimbal attached to a missile for searching reasonable angles of attack from zero to 15 degrees or greater. The seeker may be attached by a semi-strapdown mode or a pure strapdown or fixed mode.

Heretofore, current infrared seekers which have been field tested are unable to consistently attack a centroid of a target or to attack some other preferred point on the target. These type of seekers work in an infrared spectra which is basically for hotspot detection. The seekers search for and lock into the exhaust or some other surface heated above or cooled below the background field. The seeker head position and motion provides guidance data which controls the missile for attacking the target.

To permit target discrimination in a cluttered background and in the presence of counter measures, multispectra seekers have been developed which use more that one window in the infrared spectra. Algorithms of various types have also been developed in an attempt to determine the target centroid. However, these types of prior art seekers have not proven successful.

The subject infrared seeker eliminates the abovementioned problems providing advantages and a combination of unique structure heretofore not found in an infrared seeker for use in a target tracking missile and the like.

SUMMARY OF THE INVENTION

The subject invention provides a new type of hybrid imaging and non-imaging seeker that processes information available on a vidicon to a level required for target information, target discrimination, target acquisition and target attack. This type of seeker uses both hotspot and imaging techniques incorporated therein.

The seeker utilizes a video image as a second order discriminant and as a source of guidance data to permit missile attack at a target centroid or some other selected point on the target.

The invention includes a central processing unit having data processor algorithms which determine if the target meets a predefined criteria based on size, temperature, and distribution of multispectral characteristics. Tracking data based on the target position on a vidicon field of view is used to fly the missile to the target.

The seeker further includes a pointer and tracker controller used to provide pointing of the vidicon toward the target and to expand the total field of view until the selected target is located.

The semi-strapdown seeker permits a missile to fly at reasonable angles of attack with the necessary total search, scan, and track field view of capability. Further, this data is used in the missile guidance and control system.

Further, the seeker using a vidicon with a wide field of view provides a fine grained target position and rate data for use in the missile guidance and control system.

More importantly, the infrared seeker uses target hotspot characteristics as a cue to a possible target location. This greatly simplifies the processing of data generated and only targets needing hotspot or first order criteria are analyzed. Video data processing is performed only around the target in a selected field of view using image data processing techniques instead of using all of the detector or video data. This greatly reduces the amount of data processing required.

The hybrid semi-strapdown infrared seeker adapted for gimbal or non-gimbal mounting in a missile or the like includes a vidicon with vidicon face and appropriate filters and optics disposed in front thereof and directed toward a target area. The vidicon includes a vidicon controller. A threshold detector is connected to the vidicon for receiving the video output therefrom. The threshold detector has a threshold control for providing a threshold setting on the detector. The video output when in a non-imaging mode is compared with the threshold setting. When the output exceeds the setting, then this area on the vidicon face is considered a possible target. An analog to digital converter is connected to the detector for receiving the possible target data. A video preprocessor is connected to the converter for conditioning the target data. A computer central processing unit having a microprocessor and image processor is connected to the preprocessor. The processing unit further includes a target detector and acquisition algorithm for determining whether the potential target data meets a predefined criteria. A scan control is connected to the microcprocessor and the vidicon controller. The scan control expands the scan area on the vidicon face of the potential target when the potential target data meets the predefined criteria. The expanded scan data is sent through the video output to the image processor for determination of the validity of the target.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
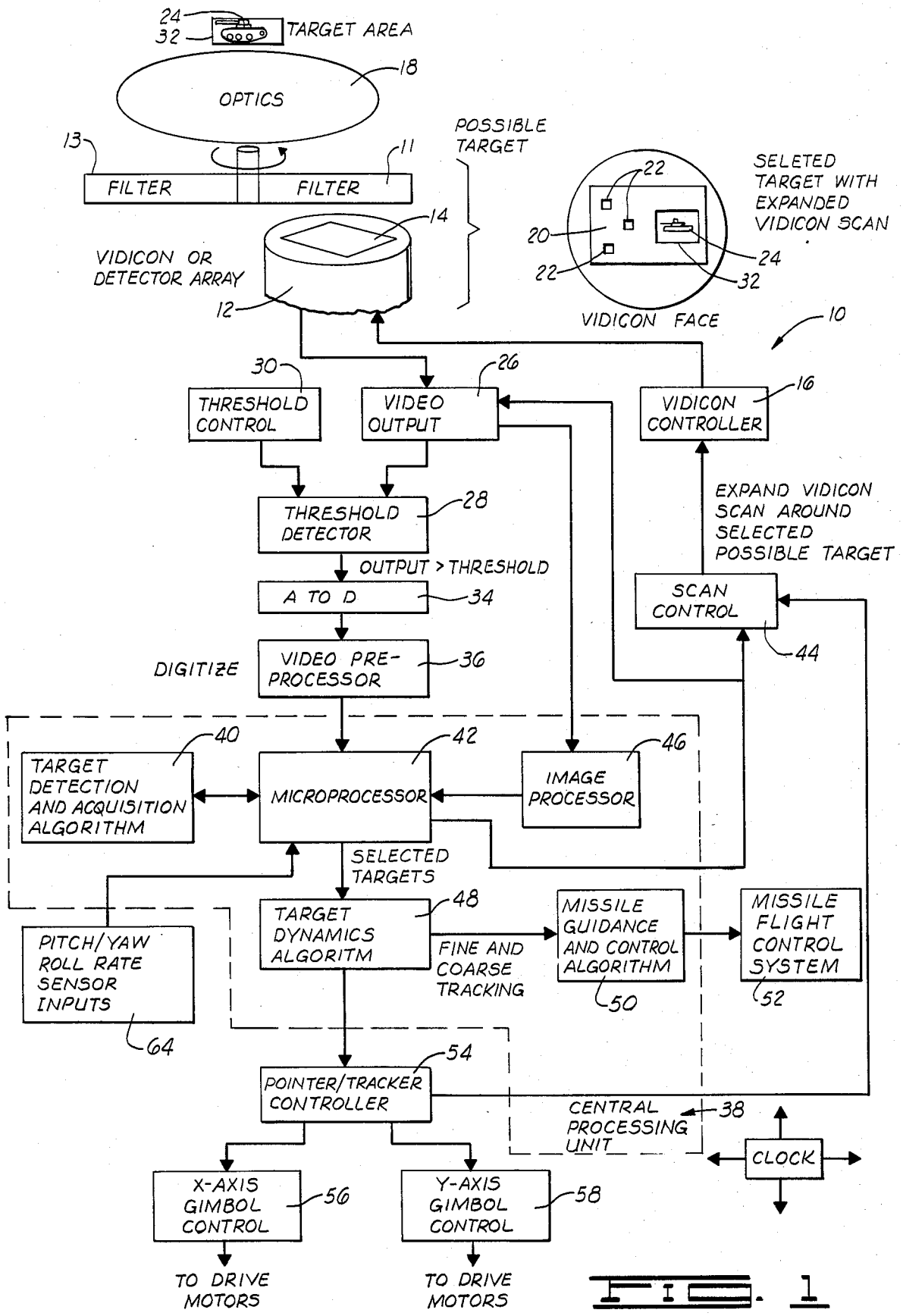
FIG. 1 illustrates a blocked diagram of the infrared seeker and controls.

In FIG. 1 the infrared seeker is designated by general reference numeral 10. The seeker 10 includes a vidicon 12 having a vidicon face 14 which vidicon controller 16 connected thereto. The vidicon 12 may be a pyroelectric vidicon or solid state detector array of the type now commercially available and having appropriate filters designated as filter 11 and filter 13 with optics 18 disposed in the front thereof for searching a target area shown by rectangle 20 having possible targets 22 and a selected target 24.

Video output 26 connected to the vidicon 12 is connected to a threshold detector 28. The detector 28 is connected to a threshold control 30. When the video output 26 of the vidicon 12 is in a non-imaging mode and compared with a threshold setting in the detector 28 and the output exceeds the threshold provided by the threshold control 30 then this position on the face 14 defines a selected area. The selected area, for example, is rectangular area 32 surrounding the selected target 24. This area 32 is now considered having a possible target of interest for attack.

The possible target data then goes to an analog to digital converter 34 and then to a video preprocessor 36 where it is conditioned and sent to a central processing unit indicated by dotted lines 38. The central processing unit 38 includes a target detection and acquisition algorithm 40 which is connected to a microprocessor 42 which receives the data from the preprocessor 36. The target detection and acquisition algorithm 40 makes a determination whether or not the potential selected target 24 meets a predefined criteria.

If the potential target 24 meets the discrimination criteria its position is sent to a scan control 44. The control 44 then expands the scan around the selected target area 32 through the use of the vidicon controller 16 and the video output 26 of this expanded scan area 32 is sent to an image processor 46 which may be part of the microprocessor 42 where a determination is made of the validity of the selected target 24.

When the potential target is too small for image recognition a target which meets the basic detection and acquisition algorithm requirements is selected. This target is then used by a target dynamics algorithm 48 to provide data to a missile guidance and control algorithm 50 which in turn is sent to a flight control system 52. Further, the target dynamics algorithm 50 is connected to a pointer and tracker controller 54 which generates data to an X axis gimbal control 56 and Y axis gimbal control 58 which in turn are connected to drive motors 60 and 62 shown in FIGS. 2 and 3 for providing the necessary control so that the potential target may be tracked by the vidicon 12.

Missile dynamic feedback is provided by pitch, jaw, and roll rate sensor inputs 64. The sensor inputs 64 are connected to the microprocessor 42.

To permit multispectral use of the seeker 10 a number of filters such as filter 11 and filter 13 may be used. These filters can be, for example, designed to exclude all infrared energy with the exception of infrared energy within a 3 to 5 micron band and 8 to 12 micron band. Depending on filter selection other micron bands may be selected.

In actual operation the field of view of the vidicon 12 is searched to determine if a hotspot which exceeds the background field occurs at a selected frequency. If a potential target such as target 24 is located alternate frequencies can be selected to aid in the target discrimination. For example, the frequencies can be selected so that the data obtained permits the hotspot to be identified as a fire or flare instead of a true target.

If the target detection and acquisition algorithm 40 determines that the target 24 is real based on size, temperature distribution, and multispectral characteristics then tracking data based on the target position on the vidicon face 14 is used to fly the missile into the target.

The pointer and tracker controller 54 is used to provide pointing of the vidicon 12 towards the target 24 and to expand the total seeker 10 field of view until a target can be located.

The imaging capability is unique in that instead of processing the video data from the vidicon 12 from the entire active surface of the face 14 only the area 32 around the target 24 is scanned. This image area 32 is scanned at an appropriate speed and the data processed to determine whether or not the target 24 meets the accepted criteria. The criteria, again, is based on size, shape, characteristics and temperature differences. The detrmination is made based on image data processing techniques and includes the use of correlation of image data with known target characteristics. In the event that an acceptable image target is not obtained, other possible target areas are then examined until an acceptable target is obtained.

Figure 2:
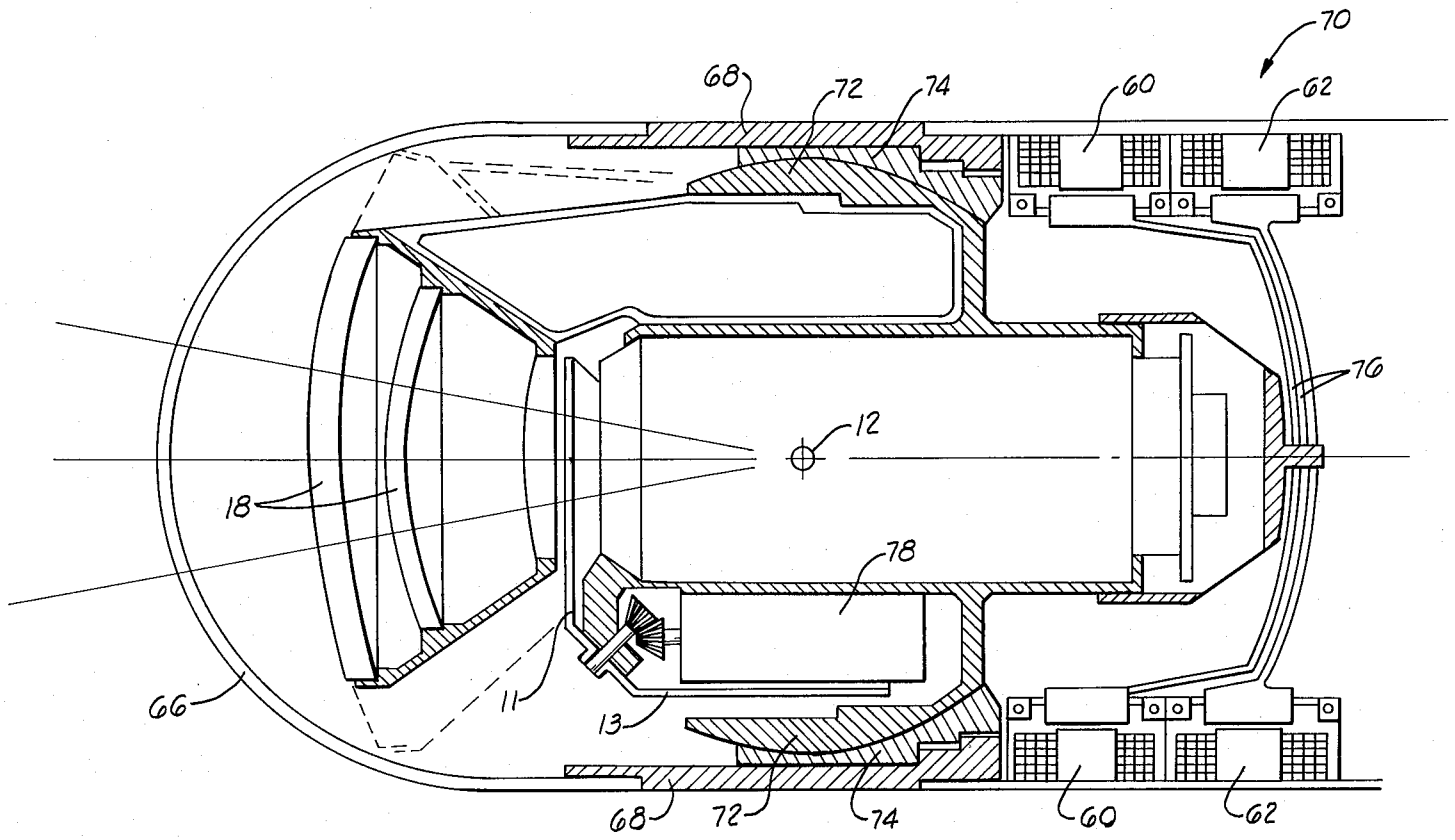
FIG. 2 illustrates the infrared seeker installed in a portion of a missile.

Referring now to FIG. 2 an aerodynamic dome 66 which is part of an airframe 68 of a missile 70 provides a transparent window for the vidicon 12. The optics 18 are made of suitable transparent material for infrared radiations at wavelengths of interest. An alternate optical system cound be used having reflective optics. This would allow the seeker 10 to use a wider frequency range. The optics 18 and the vidicon 12 are attached to a sperical bearing inner race 72 and outer race 74 of a pointer and tracker platform assembly. This type assembly is thoroughly described in U.S. Pat. No. 4,158,845. The motion of the vidicon 12 and optics 18 is accomplished by selected motion of pointer and tracker rotating cams 76. The cams 76 are moved by hollow digital stepping or drive motors 60 and 62. It should be noted that for the field of view up to approximately plus or minus 10 degrees a spearate pointer and tracker would not be required since the tracking could be performed electronically. The filters 11 and 13 are rotated by a drive motor 78 for moving the different filters in front of the vidicon 12. A blanking shutter or chopper could be included if required. For a condition where a filter is not required the filters and filter drive motor may be replaced by a polarized shutter where a second element polarization is controlled by electronic means. This type of hardware is well known for rapid controlled blanking of infrared radiation.

Figure 3:
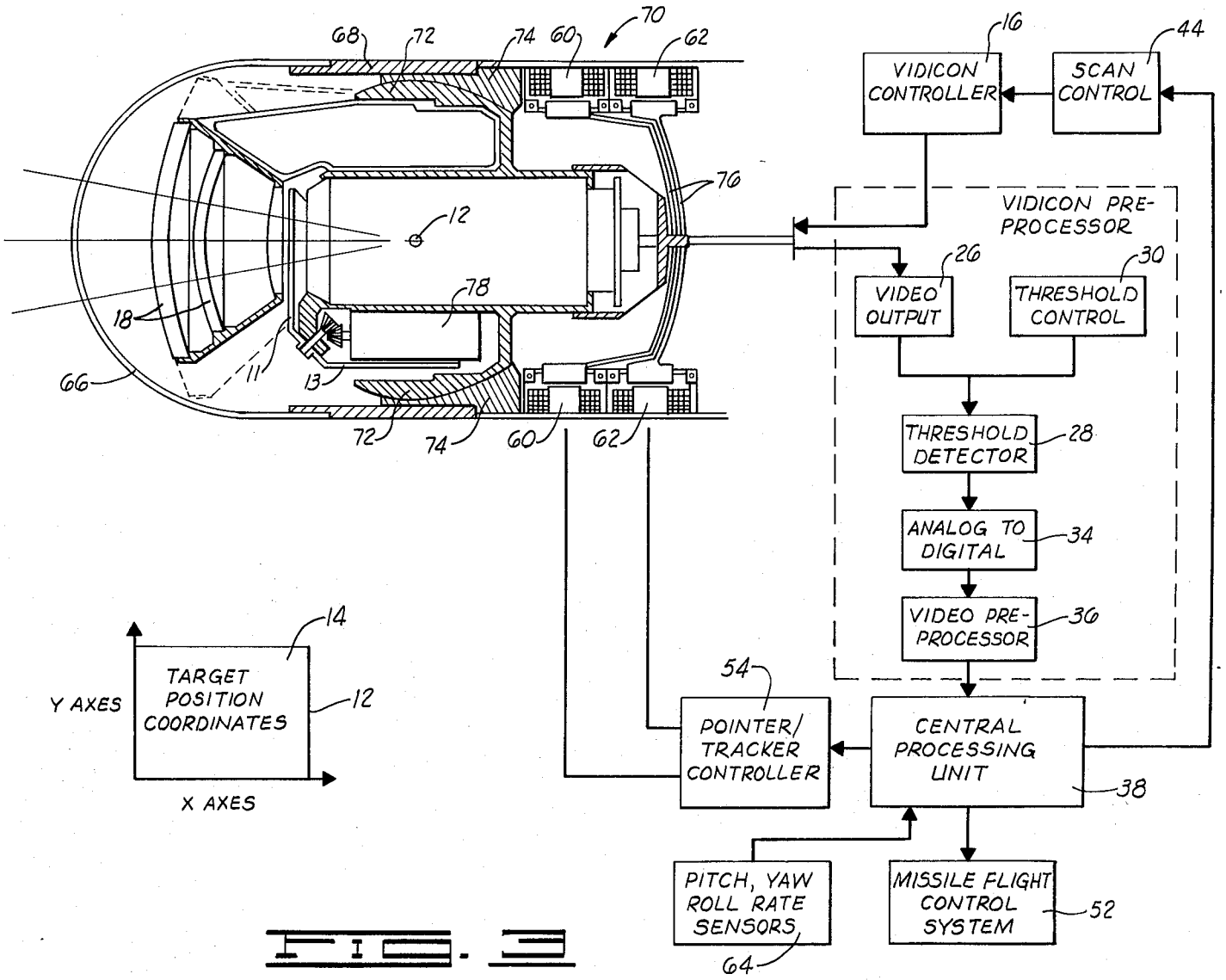
FIG. 3 illustrates all of the seeker with the controls connected to the vidicon installed in front of a missile aerodynamic dome.

In FIG. 3 the implementation of the seeker 10 is shown in the missile 70. It should be noted that an expensive seeker such as a spinning mass or a torqued gimbal head is not required. These type of heads required complex control electronics, high manuacturing precision and costly feedback support hardware to determine the seeker head position as a function of time and to assure that the head is properly pointed towards the target. The preferred implementation as shown in this figures uses instead either no head or an inexpensive head with no feedback or control loops. This is described in U.S. Pat. No. 4,158,845 to provide relatively coarse pointing of a detector and to compensate for missile motion over a required motion range. The motion is provided as an output of the video preprocessor 36. This data is derived from the position of the target 24 on the expanded selected target area 32 and the rate of change of the target 24 position.

The central processing unit 38 contains the target dynamics algorithm 48 which defines the required pointer and tracker position coordinates to the pointer and tracker controller 54. The controller 54 in the most economical implementation uses the controls 56 and 58 to drive the drive motors 60 and 62 to reposition the vidicon 12.

It should be recognized that this type of seeker 10 could use torquers and necessary position feedback transducers and control loop to give continuous and smooth motion of the vidicon 12. In this alternate implementation the drive motors 60 and 62 would be replaced by open torquers and support electronics.

Very fine target position and rate data can be obtained from the time history of the target position coordinates on the selected expanded target area 32. For some applications requiring only a relatively small field of view, for example, less than 15 degrees, the seeker 10 as described could be used in a pure strapdown mode rather than a semi-strapdown mode with resultant improved design and cost economics.

Changes may be made in the construction and arrangment of the parts or elements of the embodiments as described herein without departing from the spirit or scope of the invention defined in the following claims.

What is claimed is:

1. An infrared seeker adapted for gimballed or non-gimballed mounting in a missile and the like, the seeker comprising:

a vidicon adapted for mounting on the missile and directed toward a target area, the vidicon having a vidicon controller connected thereto;

a threshold detector connected to the vidicon for receiving vidicon output therefrom, the threshold detector having a threshold control for providing a threshold setting to the detector, the vidicon output when in a non-imaging mode compared with the threshold setting and when the output exceeds the setting that area on the vidicon is considered a possible target;

an analog to digital converter connected to the detector for receiving the possible target data;

a video preprocessor connected to the converter for conditioning the target data;

a computer central processing unit having a microprocessor connected to the preprocessor, the unit having a target detector and acquisition algorithm for determining whether or not the potential target data meets a predetermined criteria, the microprocessor having an image processor; and a scan control connected to the microprocessor and the vidicon controller, the scan control expanding the scan around the area of the potential target and if the potential target data meets the predetermined criteria the vidicon output from the expanded area is sent to the image processor for determination of the validity of the target.

2. The seeker as described in claim 1 further including pitch, yaw and roll rate sensors having an input connected to the microprocessor for providing missile dynamic feedback and stabilization input for missile guidance control during target acquisition.

3. The seeker as described in claim 1 further including a target dynamic algorithm and a missile guidance and control algorithm connected to the microprocessor to provide missile guidance and control data to a missile control system, the target dynamics algorithm connected to a pointer and tracker controller for providing X and Y coordinates of the target to X axis and Y axis controls.

4. The seeker as described in claim 3 including drive motors connected to the X axis and Y axis controls for receiving the X and Y axis control data from the pointer and tracker controller, the drive motors used for orienting the vidicon toward the target field of view.

5. The seeker as described in claim 1 further including filters disposed in front of the vidicon for receiving infrared energy thereon and optics mounted in front of the filters.

6. An infrared seeker adapted for gimballed or non-gimballed mounting in a missile and the like, the seeker comprising:

a vidicon with vidicon face and appropriate filters and optics disposed in front thereof and directed toward a target area, the vidicon having a vidicon controller;

a threshold detector connected to the vidicon for receiving vidicon output therefrom, the threshold detector having a threshold control for providing a threshold setting to the detector, when the vidicon output when compared with the threshold setting exceeds the setting then that area on the vidicon face is considered a possible target;

an analog to digital converter connected to the detector for receiving the possible target data;

a video preprocessor connected to the converter for conditioning the target data;

a central processing unit having a microprocessor connected to the preprocessor, the unit having a target detector and acquisition algorithm for determining whether the potential target data meets a predetermined criteria, the microprocessor including an image processor, the unit further including target dynamics algorithms and missile guidance and control algorithms connected to a control system of the missile; and a scan control connected to the microprocessor and the vidicon controller, the scan control also expanding the scan area of the potential target and if the potential target area meets the predetermined criteria the vidicon output of the expanded area is sent to the image processor for the determination of the validity of the target.

7. The seeker as described in claim 6 further including a pointer and tracker controller connected to the target dynamics algorithm and the scan control for providing X and Y coordinates to drive motors used in orienting the vidicon toward the possible target.

8. The seeker as described in claim 7 further including X axis and Y axis controls connected to the drive motors and the pointer and tracker controller.

9. The seeker as described in claim 6 further including pitch, yaw and roll rate sensors having an input connected to the microprocessor for providing missile dynamic feedback and stabilization input for missile guidance control during target acquisition.

* * * * *